US011873583B2

(12) United States Patent
Horihata et al.

(10) Patent No.: US 11,873,583 B2
(45) Date of Patent: Jan. 16, 2024

(54) FIBER FOR ARTIFICIAL HAIR AND HEAD ACCESSORY PRODUCT

(71) Applicant: DENKA COMPANY LIMITED, Tokyo (JP)

(72) Inventors: Atsushi Horihata, Kamakura (JP); Atsushi Takei, Kamakura (JP)

(73) Assignee: DENKA COMPANY LIMITED, Tokyo (JP)

( * ) Notice: Subject to any disclaimer, the term of this patent is extended or adjusted under 35 U.S.C. 154(b) by 342 days.

(21) Appl. No.: 17/312,985

(22) PCT Filed: Nov. 20, 2019

(86) PCT No.: PCT/JP2019/045394
§ 371 (c)(1),
(2) Date: Jun. 11, 2021

(87) PCT Pub. No.: WO2020/121759
PCT Pub. Date: Jun. 18, 2020

(65) Prior Publication Data

US 2022/0074079 A1 Mar. 10, 2022

(30) Foreign Application Priority Data

Dec. 14, 2018 (JP) ..... 2018-234894

(51) Int. Cl.
*D01F 6/60* (2006.01)

(52) U.S. Cl.
CPC ..... *D01F 6/60* (2013.01); *D10B 2331/02* (2013.01); *D10B 2503/08* (2013.01)

(58) Field of Classification Search
CPC .. A41G 3/00; A41G 5/00; C08L 63/00; C08L 67/02; C08L 77/06; D01F 6/92; D01F 6/90
USPC ..... 442/181, 215, 216; 623/15.11
See application file for complete search history.

(56) References Cited

U.S. PATENT DOCUMENTS

| | | | |
|---|---|---|---|
| 9,756,886 | B2 | 9/2017 | Kimura et al. |
| 10,385,209 | B2 | 8/2019 | Ogawa et al. |
| 2016/0255894 | A1 | 9/2016 | Kimura et al. |
| 2017/0260391 | A1 | 9/2017 | Ogawa et al. |

FOREIGN PATENT DOCUMENTS

| | | | | |
|---|---|---|---|---|
| CN | 102368919 | A | 3/2012 | |
| JP | H06-287807 | A | 10/1994 | |
| JP | 2007-332507 | A | 12/2007 | |
| JP | 2011-246843 | A | 12/2011 | |
| JP | 2011-246845 | A | 12/2011 | |
| OA | 16834 | * | 1/2016 | ..... A41G 3/00 |
| SG | 173210 | A1 | 9/2011 | |
| TW | 201105260 | A1 | 2/2011 | |
| WO | 2015/056629 | A1 | 4/2015 | |
| WO | 2016/092922 | A1 | 6/2016 | |

OTHER PUBLICATIONS

Oct. 25, 2022 Office Action issued in Chinese Patent Application No. 201980081951.7.
Jan. 7, 2020 International Search Report issued in International Patent Application No. PCT/JP2019/045394.

* cited by examiner

*Primary Examiner* — Walter E Webb
(74) *Attorney, Agent, or Firm* — Oliff PLC

(57) ABSTRACT

A fiber for artificial hair constituted of a resin composition containing an aliphatic polyamide. A weight average molecular weight Mw of a dissolved component obtained when the fiber for artificial hair is dissolved in hexafluoroisopropanol is 46,000 or more and less than 65,000.

5 Claims, No Drawings

FIBER FOR ARTIFICIAL HAIR AND HEAD ACCESSORY PRODUCT

TECHNICAL FIELD

The present invention relates to a fiber for artificial hair and a head accessory product.

BACKGROUND ART

As a material constituting a fiber for artificial hair, there is polyamide. Patent Document 1 discloses a fiber for artificial hair obtained by fiberizing a resin composition containing polyamide.

RELATED DOCUMENT

Patent Document

[Patent Document 1] Japanese Unexamined Patent Publication No. 2011-246843

SUMMARY OF THE INVENTION

Technical Problem

A fiber for artificial hair made by using polyamide as a raw material has good tactile sensation similar to human hair to some extent. The present inventors have intensively examined a relationship between the curl settability and the tactile sensation of the fiber for artificial hair made by using polyamide as a raw material, and have found that in a case where an attempt is made to improve the curl settability, there occurs a problem that squeaks easily occur and the tactile sensation is reduced.

Therefore, the present invention provides a technique relating to a fiber for artificial hair that exhibits a good curl settability and a good tactile sensation in a well-balanced manner.

Solution to Problem

According to the present invention, it is possible to provide a fiber for artificial hair constituted of a resin composition containing an aliphatic polyamide, in which a weight average molecular weight Mw of a dissolved component obtained when the fiber for artificial hair is dissolved in hexafluoroisopropanol is 46,000 or more and less than 65,000.

In addition, according to the present invention, there is provided a head accessory product using the above-mentioned fiber for artificial hair.

Advantageous Effects of Invention

According to the present invention, it is possible to provide a technique relating to a fiber for artificial hair that exhibits good curl settability and good tactile sensation in a well-balanced manner.

DESCRIPTION OF EMBODIMENTS

Hereinafter, embodiments of the present invention will be described in detail.

(Fiber for artificial hair) The fiber for artificial hair according to the embodiment is constituted of a resin composition containing an aliphatic polyamide.

A weight average molecular weight Mw of the dissolved component obtained when the fiber for artificial hair is dissolved in hexafluoroisopropanol is 46,000 or more and less than 65,000.

Hereinafter, the fiber for artificial hair of the present embodiment will be described in detail.

The aliphatic polyamide contained in the resin composition constituting the fiber for artificial hair of the present embodiment is a polyamide not having an aromatic ring, and as the aliphatic polyamide, n-nylon formed by ring-opening polymerization of lactam, or n, m-nylon synthesized by a copolymerization reaction of an aliphatic diamine and an aliphatic dicarboxylic acid is exemplified.

The number of carbon atoms of lactam is preferably 6 or more and 12 or less, and more preferably 6. The number of carbon atoms of the aliphatic diamine and the aliphatic dicarboxylic acid is preferably 6 or more and 12 or less, and more preferably 6. The aliphatic diamine and the aliphatic dicarboxylic acid preferably have functional groups (amino groups or carboxyl groups) at both ends of the carbon atom chain, but the functional groups may be provided at positions other than both ends. The carbon atom chain is preferably linear, but may have a branch. Examples of the aliphatic polyamide include polyamide 6 and polyamide 66.

Specifically, examples of the polyamide 6 include CM1007, CM1017, CM1017XL3, CM1017K, and CM1026 manufactured by Toray Industries, Inc. Examples of the polyamide 66 include CM3007, CM3001-N, CM3006, and CM3301L manufactured by Toray Industries, Inc., Zytel 101 and Zytel 42A manufactured by DuPont Co., Ltd., and Leona 1300S, 1500 and 1700 manufactured by Asahi Kasei Chemicals Co., Ltd.

The resin composition of the present embodiment preferably contains an aliphatic polyamide (A) having a weight average molecular weight of 70,000 or more and 150,000 or less and an aliphatic polyamide (B) having a weight average molecular weight of 40,000 or more and or less. The aliphatic polyamide (B) has a relatively low cost, and in a case where the resin composition of the present embodiment contains the aliphatic polyamide (B), a raw material cost of the fiber for artificial hair can be suppressed.

A lower limit of a content of the aliphatic polyamide (A) with respect to the entire resin composition is preferably 20% by mass or more, more preferably 25% by mass or more, and further more preferably 30% by mass or more. An upper limit of the content of the aliphatic polyamide (A) is preferably 80% by mass or less, more preferably 75% by mass or less, and further more preferably 70% by mass or less. By setting the content of the aliphatic polyamide (A) in the above range, good curl settability and good tactile sensation can be exhibited in a well-balanced manner.

In addition, a lower limit of the content of the aliphatic polyamide (B) with respect to the entire resin composition is preferably 20% by mass or more, more preferably 25% by mass or more, and further more preferably 30% by mass or more. An upper limit of the content of the aliphatic polyamide (B) is preferably 80% by mass or less, more preferably 75% by mass or less, and further more preferably 70% by mass or less. By setting the content of the aliphatic polyamide (B) in the above range, good curl settability and good tactile sensation can be exhibited in a well-balanced manner.

In addition, a ratio (%) of a mass of the aliphatic polyamide (A) to the sum of the mass of the aliphatic polyamide (A) and a mass of the aliphatic polyamide (B) contained in the resin composition is preferably 20% or more and 80% or less. By setting the above ratio of the mass of the aliphatic polyamide (A) in the above range, good curl settability and good tactile sensation can be exhibited in a well-balanced manner.

The resin composition may contain a semi-aromatic polyamide.

The semi-aromatic polyamide is a polyamide having a skeleton obtained by condensation polymerizing an aliphatic polyamide, an aliphatic diamine, and an aromatic dicarboxylic acid. By including the semi-aromatic polyamide, a weight average molecular weight easily becomes high. In addition, even if a flame retardant to be described later is contained, the processability of the fiber for artificial hair can be well maintained.

Examples of the aromatic dicarboxylic acid include terephthalic acid, 1,4-naphthalenedicarboxylic acid, 1,3-naphthalenedicarboxylic acid, 1,2-naphthalenedicarboxylic acid, isophthalic acid, and the like. Among these, terephthalic acid is preferably contained as a main component.

Examples of the aliphatic diamine include linear aliphatic diamines such as 1,4-butanediamine, 1,5-pentanediamine, 1,6-hexanediamine, 1,7-heptanediamine, 1,8-octanediamine, 1,9-nonanediamine, 4-methyl-1,8-octanediamine, 1,10-decadiamine, 1,11-undecanediamine, and 1,12-dodecanediamine, branched aliphatic diamines such as 2-methyl-1,8-octanediamine, 4-methyl-1,8-octaneamine, 5-methyl-1,9-nonanediamine, and alicyclic diamines such as isophoronediamine, norbornandimethylamine, and tricyclodecanedimethylamine, and the like. Among these, an aliphatic diamine having 10 carbon atoms is preferable, and 1,10-decadiamine is more preferable.

In addition, as the semi-aromatic polyamide, those having a melting point of 280° C. to 350° C. are preferable. With this, heat resistance during hair processing can be obtained, and a fiber for artificial hair having both tactile sensation and curl property can be easily obtained.

Specific examples of the semi-aromatic polyamide resin include nylon 4T (PA4T), nylon 6T (PA6T), nylon MXD6 (PAMXD6), nylon 9T (PA9T), nylon 10T (PA10T), nylon 11T (PA11T), nylon 12T (PA12T), nylon 13T (PA13T), and the like.

A lower limit of a content of the semi-aromatic polyamide with respect to the entire resin composition is preferably 1% by mass or more, more preferably 2% by mass or more, and further more preferably 4% by mass or more. On the other hand, an upper limit of the content of the semi-aromatic polyamide is preferably 20% by mass or less, more preferably 15% by mass or less, and further more preferably 10% by mass or less. By setting the content of the semi-aromatic polyamide in the above range, it is possible to suppress deterioration in processability in a case where an additive such as a flame retardant to be described later is contained.

The weight average molecular weight Mw of a hexafluoroisopropanol-dissolved component of the fiber for artificial hair of the present embodiment is specified. Examples of a preferable method for measuring the weight average molecular weight Mw include performing measurement with a gel permeation chromatography (hereinafter, referred to as GPC) using a solution obtained after mixing and stirring a fiber for artificial hair and hexafluoroisopropanol at 25° C. for 6 hours using an ultrasonic cleaner.

The lower limit of the weight average molecular weight Mw of the dissolved component obtained when the fiber for artificial hair is dissolved in hexafluoroisopropanol is preferably 46,000 or more, more preferably 48,000 or more, and further more preferably 50,000 or more. On the other hand, an upper limit of the weight average molecular weight Mw is less than 65,000, preferably 63,000 or less, and more preferably 61,000 or less.

By setting the weight average molecular weight Mw to be equal to or more than the above lower limit value, it is possible to improve the curl settability while maintaining good tactile sensation. On the other hand, by setting the weight average molecular weight Mw to be equal to or less than the above upper limit value, it becomes easy to reduce squeaks while maintaining good curl settability. In addition, by setting the weight average molecular weight Mw to the above range, good curl settability and good tactile sensation can be exhibited in a well-balanced manner.

As a method for controlling the weight average molecular weight Mw of the hexafluoroisopropanol-dissolved component of the fiber for artificial hair within the above numerical value range, it is possible to perform adjustment by the weight average molecular weight of the aliphatic polyamide, combination of the aliphatic polyamides, and the like.

In addition, the weight average molecular weight Mw of the hexafluoroisopropanol-dissolved component of the fiber for artificial hair can be measured by using GPC (gel permeation chromatography).

The molecular weight distribution of the hexafluoroisopropanol-dissolved component of the fiber for artificial hair of the present embodiment can be obtained by using weight average molecular weight (Mw)/number average molecular weight (Mn) as an index. The weight average molecular weight (Mw)/number average molecular weight (Mn) is preferably 2.0 to 3.0, more preferably 2.1 to 2.9, and further more preferably 2.2 to 2.8.

By setting the weight average molecular weight (Mw)/number average molecular weight (Mn) within the above numerical value range, good curl settability and good tactile sensation can be exhibited in a well-balanced manner.

<Additives>

The resin composition used in the present embodiment may contain additives, if necessary, for example, flame retardant, flame retardant aid, fine particles, heat resistant agent, light stabilizer, fluorescent agent, antioxidant, antistatic agent, pigment, dye, plasticizer, lubricant, and the like.

Examples of the above-mentioned flame retardants include brominated flame retardant, phosphorus flame retardant, nitrogen flame retardant, hydrated metal compound, and the like. Among these, a brominated flame retardant is preferable from a viewpoint of compatibility with the aliphatic polyamide. Examples of the brominated flame retardant include a brominated epoxy resin, a brominated phenoxy resin, and the like. The compound may be used alone, or two or more thereof may be used by being combined together.

A content of the flame retardant is preferably 1% to 20% by mass, and more preferably 5% to 15% by mass, based on the entire resin composition.

(Method for Producing Fiber for Artificial Hair)

An example of a method for producing a fiber for artificial hair according to an embodiment will be described, but the present invention is not limited thereto.

First, the resin composition containing the above-mentioned aliphatic polyamide is melt-kneaded. As an apparatus for melt-kneading, various general kneading machines can be used. Examples of the melt-kneading include a single-screw extruder, a twin-screw extruder, a roll, a Banbury mixer, a kneader, and the like. Among these, the twin-screw extruder is preferable from a viewpoint of adjusting the degree of kneading and easiness of operation. The fiber for artificial hair can be produced by melt-spinning by a normal melt-spinning method under appropriate temperature conditions depending on the type of polyamide.

In a case where polyamide 66 is used as the aliphatic polyamide and polyamide 10T is used as the semi-aromatic polyamide in a predetermined ratio, melt-spinning is performed at a temperature of 270° C. or more and 310° C. or less in a melt-spinning device such as an extruder, a base, and if necessary, a gear pump, cooling is performed in a water tank containing cooling water, and a take-up speed is adjusted while performing control of fineness to obtain an undrawn yarn. The temperature of the melt-spinning apparatus can be appropriately adjusted according to the ratio of the addition amount of the aliphatic polyamide and the semi-aromatic polyamide. In addition, regardless of cooling by a water tank, spinning by cooling with cold air is also possible. The temperature of the cooling water tank, the temperature of the cold air, the cooling time, and the take-up speed can be appropriately adjusted according to the discharge amount and the number of holes in the base.

In the case of melt spinning, a spinning nozzle with not only a simple circular shaped nozzle hole but also a spinning nozzle with a specially shaped nozzle hole is used to cause the cross-sectional shape of the fiber for artificial hair to be heteromorphic such as cocoon-shaped, Y-shaped, H-shaped, X-shaped, petal-shaped, and the like.

The obtained undrawn yarn is subjected to a drawing treatment in order to improve the tensile strength of the fiber. The drawing treatment may include any method of a two-step method in which the undrawn yarn is once wound on a bobbin and then drawn in a step different from the melt spinning step, or a direct spinning drawing method in which the undrawn yarn is continuously drawn from the melt spinning step without being wound on the bobbin. In addition, the drawing treatment is performed by a one-step drawing method of performing drawing to a targeted drawing ratio at one time, or a multi-step drawing method of performing drawing to a targeted drawing ratio by performing drawing two or more times. As heating means in a case of performing heat drawing treatment, a heating roller, a heat plate, a steam jet device, a hot water tank, and the like can be used, and these can also be appropriately used in combination.

The lower limit of the fineness of the fiber for artificial hair of the present embodiment is preferably 10 dtex or more, more preferably 30 dtex or more, and further more preferably 35 dtex or more. In addition, the upper limit of the fineness of the fiber for artificial hair of the present embodiment is preferably 150 dtex or less, and more preferably 120 dtex or less.

With the fiber for artificial hair described above, good curl settability and good tactile sensation can be exhibited in a well-balanced manner.

In particular, in a case where the resin composition constituting the fiber for artificial hair contains an aliphatic polyamide (B) of which raw material cost is relatively low, good curl settability and good tactile sensation can be exhibited while reducing the production cost of the fiber for artificial hair.

(Head accessory product) The above-mentioned fiber for artificial hair is suitably used as a fiber constituting a head accessory product. The head accessory product is an ornament that decorates a person's head, and is specifically a wig, a partial wig, a hair piece, a blade, an extension hair, a doll hair, a ribbon, a bead, and the like.

Hereinabove, the embodiments of the present invention have been described above, but these are examples of the present invention and various configurations other than the above can be adopted.

Example 1

Hereinafter, the present invention will be described with reference to examples and comparative examples, but the present invention is not limited thereto.

The aliphatic polyamides and semi-aromatic polyamides dried so as to have a moisture absorption rate of less than 1,000 ppm were blended so as to have the blending ratios shown in Tables 1-1 and 1-2. Details of the used aliphatic polyamides and semi-aromatic polyamides are as follows, and these were obtained by a known production method described in JP-A-2008-274086 and the like.

Aliphatic polyamide A: nylon 66, weight average molecular weight Mw 90,000, manufactured by DuPont, Zytel 42A Aliphatic polyamide B: nylon 66, weight average molecular weight Mw 50,000, Toray Industries, Inc., MILAN CM3001-N Aliphatic polyamide C: nylon 66, weight average molecular weight Mw 160,000, manufactured in-house Aliphatic polyamide D: nylon 66, weight average molecular weight Mw 60,000, manufactured in-house Aliphatic polyamide E: nylon 66, weight average molecular weight Mw 30,000, manufactured in-house Semi-aromatic polyamide: nylon 10T, TVESTAMID HO Plus M3000, manufactured by Daicel Evonik Ltd.

The blended material or the material used alone was kneaded using a φ30 mm twin-screw extruder to obtain raw material pellets for spinning.

Then, after dehumidifying and drying the pellets so that the water absorption rate was 1,000 ppm or less, spinning was performed using a φ40 mm single-shaft melt-spinning device, and while cooling a molten resin discharged from a die having a hole diameter of 0.5 mm/piece through a water tank at about 30° C., a discharge amount and a winding speed were adjusted to prepare an undrawn yarn having a set fineness. A set temperature of the φ40 mm melt-spinning device was appropriately adjusted according to the ratio of the addition amount of the aliphatic polyamides and the semi-aromatic polyamides.

The obtained undrawn yarn was drawn at 100° C., and then annealed at 180° C. to obtain a fiber for artificial hair having a predetermined fineness. Drawing was performed at a draw magnification of 3 times and a relaxation rate at a time of annealing of 5%. The relaxation rate at the time of annealing is a value calculated by (rotational speed of the take-up roller at the time of annealing)/(rotational speed of the feeding roller at the time of annealing).

Regarding the obtained fiber for artificial hair, evaluation was performed for weight average molecular weight, number average molecular weight, tactile sensation, and curl settability according to the evaluation methods and criteria to be described later. The evaluation results are shown in Tables 1-1 and 1-2.

[Weight Average Molecular Weight Mw, Number Average Molecular Weight Mn]

Using a solution obtained after mixing and stirring the obtained fiber for artificial hair and hexafluoroisopropanol at 25° C. for 6 hours using an ultrasonic cleaner, using gel permeation chromatography, the following measurements were performed.

The weight average molecular weight Mw and the number average molecular weight Mn were obtained by measurement under the following equipment and conditions.

Used device: Pump . . . shodex DS-4

Column . . . shodex GPC HFIP-806M×2+HFIP-803

Detector . . . shodex RI-71

Eluent: Hexafluoroisopropanol (+additive $CF_3COONa$ (5 mmol/L))

Pre-treatment: Filtration with membrane filter—(0.2 μm)

Concentration: 0.2 w/v %

Injection amount: 100 μL

Column temperature: 40° C.

Flow rate: 1.0 ml/min

Standard substance: Standard polymethylmethacrylate (PMMA)

A calibration curve was prepared by standard PMMA, and a weight average molecular weight Mw and a number average molecular weight Mn were expressed by PMMA conversion values.

[Tactile Sensation (Squeakiness)]

The tactile sensation (squeakiness) of the fiber for artificial hair of each example and each comparative example was evaluated by the following method.

Using a fiber bundle sample in which fibers for artificial hair were bundled to a length of 250 mm and a weight of 20 g, evaluation was performed by determination by touch of 10 treatment technicians of fiber for artificial hair (with 5 years or more of work experience) according to the following evaluation criteria.

A (excellent): Nine or more technicians evaluated that the squeakiness was low.

B (good): Seven or eight technicians evaluated that the squeakiness was low.

C (bad): Six or less technicians evaluated that the squeakiness was low.

The lower the squeakiness of the fiber for artificial hair, the better the tactile sensation becomes.

[Curl Settability]

The curl settability of the fiber for artificial hair of each example and each comparative example was evaluated by the following method.

The fiber for artificial hair was adjusted to a length of 50 cm and a total weight of 2.0 g to forma fiber bundle, the fiber bundle was wound around an iron (iron diameter 1.4 cm) made of iron at 180° C. to be curled, then the fiber bundle was separated from the iron, and it was checked whether or not there was curl when an end was fixed and suspended. A curled state was defined as a case where an interval between a base end and a tip end of the fiber for artificial hair when suspended was less than 0.85 times (less than 42.5 cm) the total length of 50 cm before curling. As a sample before evaluation, a sample stored at a temperature of 23° C. and a humidity of 50% for 24 hours was adopted in order to eliminate variations in evaluation. The curl settability of the fiber for artificial hair was determined according to the following criteria depending on the heating time with the iron required for the curl setting.

A (excellent): The curl was set when the heating time with an iron was less than 5 seconds.

B (good): The curl was set when the heating time with an iron was 5 seconds or more and less than 10 seconds.

C (bad): The curl was set when the heating time with an iron was 10 seconds or more.

[Processability]

Regarding the processability of undrawn yarns made of fibers for artificial hair in each example and each comparative example, the number of yarn breakages that occurred when 100 bundles of undrawn yarns were subjected to drawing treatment at three times of the draw magnification for 30 minutes was evaluated. Specifically, after the drawing treatment for 30 minutes, the obtained drawn yarn was visually observed, the number of yarn breakages was counted, and the processability was evaluated according to the following evaluation criteria.

A (excellent): Yarn breakage was 0 times/30 minutes

B (good): Yarn breakage was 1 time or more and less than 3 times/30 minutes

C (bad): Yarn breakage was 3 times or more and less than 10 times/30 minutes

TABLE 1

| | | Unit | Example 1 | Example 2 | Example 3 | Example 4 | Example 5 | Example 6 | Example 7 | Example 8 |
|---|---|---|---|---|---|---|---|---|---|---|
| Blending ratio of resin composition | Aliphatic polyamide A (weight average molecular weight Mw: 90,000) | Mass % | 30 | 50 | 70 | 45 | — | — | — | — |
| | Aliphatic polyamide B (weight average molecular weight Mw: 50,000) | Mass % | 70 | 50 | 30 | 50 | — | 50 | — | 50 |
| | Aliphatic polyamide C (weight average molecular weight Mw: 160,000) | Mass % | — | — | — | — | 50 | 50 | 50 | — |
| | Aliphatic polyamide D (weight average molecular weight Mw: 60,000) | Mass % | — | — | — | — | 50 | — | — | 50 |
| | Aliphatic polyamide E (weight average molecular weight Mw: 30,000) | Mass % | — | — | — | — | — | — | 50 | — |
| | Semi-aromatic polyamide | Mass % | — | — | — | 5 | — | — | — | — |
| Evaluation result | Weight average molecular weight Mw ($\times 10^4$) of dissolved component | — | 5.0 | 5.4 | 6.0 | 5.5 | 6.4 | 6.3 | 6.1 | 4.8 |

TABLE 1-continued

| | | | | | | | | | | |
|---|---|---|---|---|---|---|---|---|---|---|
| | Number average molecular weight Mn ($\times 10^4$) of dissolved component | — | 2.2 | 2.3 | 2.4 | 2.3 | 2.5 | 2.5 | 2.4 | 2.2 |
| | Tactile sensation (squeakiness) | — | A | A | A | A | B | B | B | A |
| | Curl settability | — | A | A | A | A | A | A | A | B |

| | | Unit | Example 9 | Example 10 | Example 11 | Comparative Example 1 | Comparative Example 2 | Comparative Example 3 | Comparative Example 4 |
|---|---|---|---|---|---|---|---|---|---|
| Blending ratio of resin composition | Aliphatic polyamide A (weight average molecular weight Mw: 90,000) | Mass % | — | 50 | 50 | — | 100 | 90 | 70 |
| | Aliphatic polyamide B (weight average molecular weight Mw: 50,000) | Mass % | — | — | — | 100 | — | 10 | — |
| | Aliphatic polyamide C (weight average molecular weight Mw: 160,000) | Mass % | — | — | — | — | — | — | — |
| | Aliphatic polyamide D (weight average molecular weight Mw: 60,000) | Mass % | 50 | 50 | — | — | — | — | — |
| | Aliphatic polyamide E (weight average molecular weight Mw: 30,000) | Mass % | 50 | — | 50 | — | — | — | — |
| | Semi-aromatic polyamide | Mass % | — | — | — | — | — | — | 30 |
| Evaluation result | Weight average molecular weight Mw ($\times 10^4$) of dissolved component | — | 4.7 | 5.9 | 5.2 | 4.5 | 7.7 | 7.3 | 6.6 |
| | Number average molecular weight Mn ($\times 10^4$) of dissolved component | — | 2.1 | 2.4 | 2.2 | 1.9 | 2.8 | 2.7 | 2.6 |
| | Tactile sensation (squeakiness) | — | A | A | A | A | C | C | C |
| | Curl settability | — | B | B | B | C | A | A | A |

As shown in Tables 1-1 and 1-2, in each fiber for artificial hair of Examples 1 to 4 containing an aliphatic polyamide (A) having a weight average molecular weight Mw of 70,000 or more and 150,000 or less and an aliphatic polyamide (B) having a weight average molecular weight Mw of 40,000 or more and 55,000 or less, both the tactile sensation (squeakiness) and the curl settability were evaluated as A (excellent). In the fibers for artificial hair of Examples 5 to 11 not containing at least one of the aliphatic polyamide (A) and the aliphatic polyamide (B), either one of the tactile sensation (squeakiness) and the curl settability was evaluated as A (excellent), whereas the other was evaluated as B (good). In addition, in each fiber for artificial hair of Comparative Examples 1 to 4, either one of the tactile sensation (squeakiness) and the curl settability was evaluated as C (bad).

Regarding the fibers for artificial hair of Examples 12 to 15 in which a predetermined amount of flame retardant was added to the resin composition having the same blending and ratio as those of the fibers for artificial hair of Examples 1 to 4, in addition to the evaluation of the above-mentioned weight average molecular weight Mw, the tactile sensation, and the curl settability, the evaluation of processability was performed. The evaluation results are shown in Table 2. The flame retardants used for the fibers for artificial hair of Examples 12 to 15 are as follows.

Brominated epoxy resin: SRT-20000, manufactured by Sakamoto Yakuhin Kogyo Co., Ltd.

TABLE 2

| | | Unit | Example 12 | Example 13 | Example 14 | Example 15 |
|---|---|---|---|---|---|---|
| Blending ratio of resin composition | Aliphatic polyamide A (weight average molecular weight Mw: 90,000) | Mass % | 27.3 | 45.5 | 63.5 | 40.9 |
| | Aliphatic polyamide B (weight average molecular weight Mw: 50,000) | Mass % | 63.5 | 45.4 | 27.3 | 45.5 |
| | Semi-aromatic polyamide | Mass % | — | — | — | 4.5 |

TABLE 2-continued

| | | Unit | Example 12 | Example 13 | Example 14 | Example 15 |
|---|---|---|---|---|---|---|
| | Flame retardant (brominated epoxy resin) | Mass % | 9.1 | 9.1 | 9.1 | 9.1 |
| Evaluation result | Weight average molecular weight Mw ($\times 10^4$) of dissolved component | — | 4.9 | 5.4 | 5.9 | 5.5 |
| | Number average molecular weight Mn ($\times 10^4$) of dissolved component | — | 2.2 | 2.3 | 2.4 | 2.3 |
| | Tactile sensation (squeakiness) | — | A | A | A | A |
| | Curl settability | — | A | A | A | A |
| | Processability | — | B | B | B | A |

As shown in Table 2, in the fibers for artificial hair of Examples 12 to 14 containing a flame retardant in addition to the aliphatic polyamide A and the aliphatic polyamide B, the processability was evaluated as B (good), but in the fiber for artificial hair of Example further containing semi-aromatic polyamide, the processability was evaluated as A (excellent), and it was confirmed that deterioration in the processability due to the contained flame retardant can be compensated by containing the semi-aromatic polyamide.

Priority is claimed on Japanese Patent Application No. 2018-234894, filed on Dec. 14, 2018, the content of which is incorporated herein by reference.

The invention claimed is:

1. A fiber for artificial hair composed of a resin composition containing an aliphatic polyamide, wherein a weight average molecular weight Mw of a dissolved component obtained when the fiber for artificial hair is dissolved in hexafluoroisopropanol is 46,000 or more and less than 65,000, and wherein the resin composition contains an aliphatic polyamide (A) having a weight average molecular weight of 70,000 or more and 150,000 or less and an aliphatic polyamide (B) having a weight average molecular weight of 40,000 or more and or less.

2. The fiber for artificial hair according to claim 1, wherein a content of the aliphatic polyamide (A) with respect to the entire resin composition is 20% by mass or more and 80% by mass or less, and a content of the aliphatic polyamide (B) with respect to the entire resin composition is 20% by mass or more and 80% by mass or less.

3. The fiber for artificial hair according to claim 1, wherein the resin composition further contains a semi-aromatic polyamide, and a content of the semi-aromatic polyamide with respect to the entire resin composition is 1% by mass or more and 20% by mass or less.

4. The fiber for artificial hair according to claim 1, wherein the aliphatic polyamide is at least one selected from the group consisting of polyamide 6 and polyamide 66.

5. A head accessory product using the fiber for artificial hair according to claim 1.

* * * * *